US005131896A

United States Patent [19]

Hutchings

[11] Patent Number: 5,131,896

[45] Date of Patent: Jul. 21, 1992

[54] MULTI-FORCE BREAKING BOARD FOR MARTIAL ARTS

[76] Inventor: Perry L. Hutchings, 146 Old Dundee Rd., Barrington, Ill. 60010

[21] Appl. No.: 567,382

[22] Filed: Aug. 14, 1990

[51] Int. Cl.[5] ..... A63B 69/00

[52] U.S. Cl. ..... 482/83; 482/908

[58] Field of Search ..... 272/76, 77, 78, 93, 272/94, 96, DIG. 4

[56] References Cited

U.S. PATENT DOCUMENTS

| | | | |
|---|---|---|---|
| 3,883,135 | 5/1975 | Milliken | 272/76 X |
| 4,004,799 | 1/1977 | Kundert | 272/76 X |
| 4,052,056 | 10/1977 | Friedenthal | 272/76 |
| 4,083,557 | 4/1978 | Friedenthal | 272/76 |
| 4,365,800 | 12/1982 | Hay et al. | 272/76 |

*Primary Examiner*—Richard J. Apley
*Assistant Examiner*—Joe H. Cheng
*Attorney, Agent, or Firm*—Charles F. Meroni, Jr.

[57] ABSTRACT

A karate practice board for subjection to hand and foot strikes comprises all permanent parts, by which the practice board or striking board can be manufactured and reused to reduce the cost of engaging in this sport or hobby. The striking board is comprised of a pair of rigid parts, and an insert part is adapted to be assembled between the rigid parts. The rigid parts are provided with cavities in which the insert part can be received in locked assembly. One of the rigid parts and the insert part are provided with a severable joint that can be severed by striking a karate hand or foot blow to the board preferably in proximity of the insert part. The kit is provided with a series of insert parts of varying length and strength which will require different predetermined severing forces to cause the board made with such parts to be severed.

13 Claims, 3 Drawing Sheets

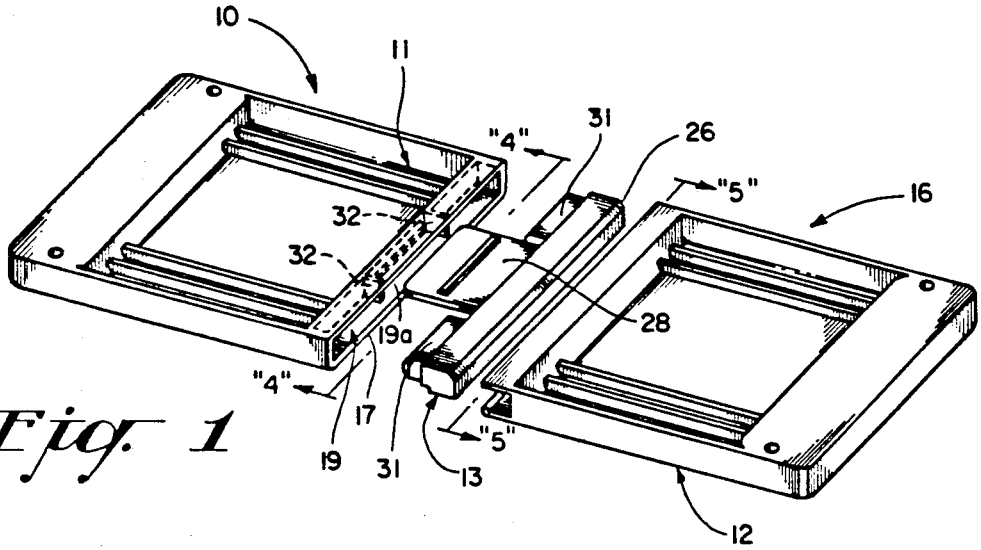
Fig. 1
Fig. 2
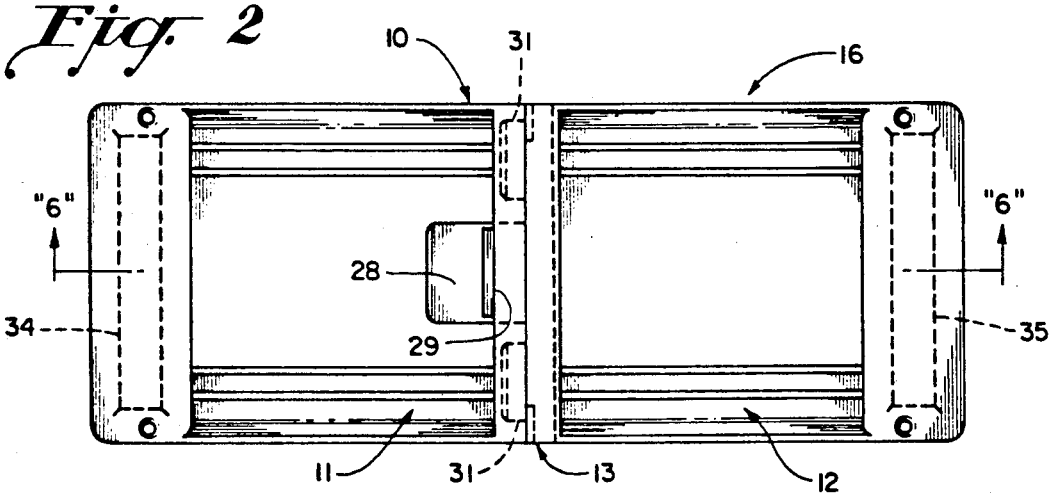
Fig. 3
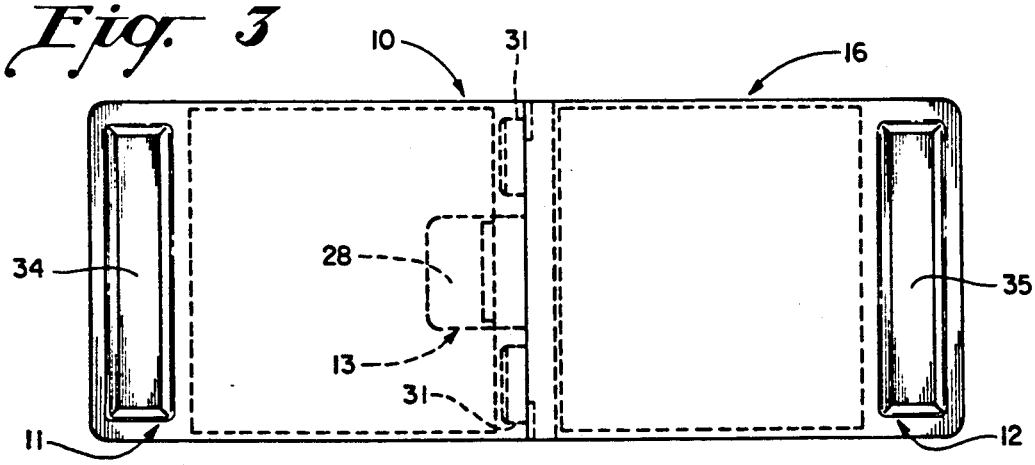

MULTI-FORCE BREAKING BOARD FOR MARTIAL ARTS

BACKGROUND OF THE INVENTION

The present invention relates to practice equipment for the martial arts and, more particularly, to a novel multi-part karate practice board for hand and foot strikes where all parts are reusable to minimize waste and expense.

Karate practitioners frequently break wooden boards or like members in order to develop and demonstrate powerful hand and foot strikes. One board or a stack of boards is supported at its opposite edges, generally with its grain running parallel to these edges, and is struck medially by the foot or the hand. If the strike is sufficiently powerful and properly executed, the board or boards will break in two. In the past, boards thus broken have been discarded thus creating a substantial amount of waste product. Since a typical karate practitioner thus may destroy many boards each day, as many as 10, 2.5 centimeter thick boards at a single blow, karate practice can be unduly expensive and wasteful. Also wooden boards tend to vary unpredictably in their resistance to severing force so that, in the past, the karate practitioner has had no calibrated gauge of the force he is capable of delivering.

Various types of more permanent and uniform types of karate striking boards made from synthetic plastics have been developed in the past, and typical examples are shown in U.S. Pat. Nos. 4,004,799, and 4,052,056. In the 056', the insert parts are of a severable variety but cannot be reused once severed, and hence the insert parts disclosed in this prior patent must be discarded. In the 799' patent, a key and slot type connection is provided to permit selective adjustment of the holding force so that an adjustable required breaking force is needed to enable the pine board members to be separated through the application of hand and foot karate strikes thereto. The karate board disclosed in the 799' patent has wood or pine board members at opposite ends, and synthetic plastic insert parts mounted there between and held in place by the key and slot structure as described.

It is believed that my new karate striking board kit and karate board is distinctly advantageous over the above described prior art for no wooden components are used, and the kit and its components are totally reusable for subsequent practice exercises since the rigid and insert parts are all made from a suitable synthetic plastic. The insert parts can be selectively assembled with the rigid parts to create different board strengths without having the necessity of adjusting keys of the type shown in the 799' patent and the like to create striking boards of varying strengths. Since all parts are of a plastic construction, and since the joints between my rigid parts and the insert part are severable and reassemblable or rejoinable, all components can be reused without waste.

There is only one joint that is separable upon delivery of a karate blow according to an important feature of my invention. My insert part or piece stays assembled with one of the rigid parts and does not detach from one rigid part while detaching from another rigid part when the board is subjected to a karate blow at its flexible joint in contrast to the prior patented art when the *insert* detaches from both rigid parts. This is a contrast to the karate board shown in the 799' patent where patentee states that it is important that his key 9 does not remain attached to his rigid parts after delivery of a karate blow (See column 5, lines 55–57).

SUMMARY OF THE INVENTION

According to important object of the present invention, I have provided a reusable karate striking board kit comprising first and second substantially rigid parts having spaced apart confronting edges and spaced apart confronting cavities in the confornting edges, the confronting cavity in one of the confronting edge of the first and second rigid parts extending width wise providing side cavity openings, the another confronting cavity in another of the confronting edge of the first and second rigid parts being closed at transversely opposite ends, a plurality of reusable, non-breakable insert parts alternatively and selectably constructed for assembly and reassembly between the first and second rigid parts, the insert parts each having opposite insert margins for coaction with the confronting edges and the confronting cavities, the insert margins each having portions thereof removably insertable in the confronting cavities of the first and second rigid parts to render the confronting edges of the first and second rigid parts contiguous with the opposite insert margins of an associated one of the insert parts, one of the insert margins being temporarily joined with a contiguous one of the first and second rigid parts and temporarily joined along an elongated transverse junction positioned there between, each of the insert parts having varied lengths to require varied karate strike forces at the junction to separate the insert part from only one of the first and second rigid parts, and releasable joint means between one of the insert parts and an associated one of the first and second rigid parts, the releasable joint means releases upon being struck by a karate strike force against the associated one of the insert part, one of the portions of the insert margins having an integral longitudinally extending locking tongue, the locking tongue having an offset locking projection, the locking tongue being retainingly engageable in the another confronting cavity of the first and second rigid parts, the another confronting cavity of the first and second rigid parts having a locking cavity shoulder and with the offset locking projection engaged behind the locking cavity shoulder to secure the insert part in assembly, the locking tongue being manually depressible to release and disengage the offset locking projection from the locking cavity shoulder to disengage the insert part, the insert part has a pair of transversely spaced stabilizing lugs positioned on opposite sides of the locking tongue, the stabillizing lugs and the locking tongue being simultaneously engaged in the another confronting cavity of the first and second rigid parts for securement.

Yet other features of my invention concern the kit being provided with sliding lock means located between an edge of one of the first and second parts in a selected one of the insert parts for securing them in assembly together.

According to other features of my invention, a selected one of the insert parts has a chamfered inner edge for disposition in one of the cavities, one of the cavities having a deflectable leg, deflectable over the chamfered inner edge upon a karate strike force or blow being struck against the associated one of said insert parts permitting the insert parts and one of the first and second parts to become disengaged from the insert part previously assembled therewith.

Other and still further features of my invention concern a reusable karate striking board comprising first and second substantially rigid parts, the first part and the second part having spaced apart confronting margins and spaced apart confronting cavities in the confronting margins, a reusable, non-breakable insert part constructed for assembly and reassembly when located between the first and second parts, the insert part having opposite insert margins for co-action with the confronting edges and the confronting cavities, the insert part having portions thereof removably insertable in the cavities of the first and second parts to render the matched confronting margins contiguous with the opposite confronting insert margins of the insert part, one of the insert margins being temporarily joined with a contiguous one of the first and second parts and temporarily joined along an elongated transverse junction positioned there between, the insert part being separable at the junction when subjected to a karate blow to separate the insert part from only one of the first and second substantially rigid parts, and releasable joint means between the insert part and an associated one of the first and second parts which joint means releases upon being struck by a karate strike force or blow against the insert part.

BRIEF DESCRIPTION OF THE DRAWINGS

Other objects and features of my invention will now become apparent from a consideration of the drawings which are here presented and which illustrate my invention, as follows:

FIG. 1 is an exploded bottom view of my karate striking board;

FIG. 2 is a bottom plan view of the board shown in FIG. 1;

FIG. 3 is a top plan view of the board shown in FIGS. 1 and 2;

DESCRIPTION OF A PREFERRED EMBODIMENT

Figure 4:
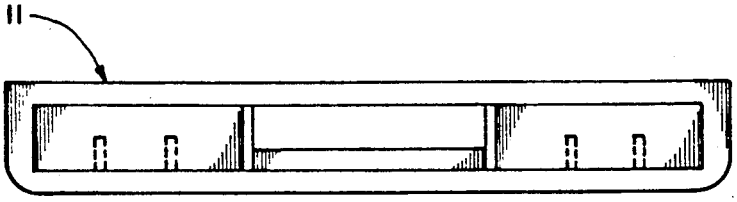
FIG. 4 is an end view as viewed on the lines 4—4 looking in the direction indicated by the arrows as seen in FIG. 1.

The reference numeral 10 indicates my karate striking board kit 10. The kit 10 includes a first rigid part 11 and a second rigid part 12, along with a series of different types of insert parts with the type shown in FIG. 1 indicated at 13. These rigid parts 11 and 12 and the insert part 13 collectively comprise a karate striking board 16. The inserts can be of different types as shown in FIGS. 6, 7 and 8.

Figure 6:
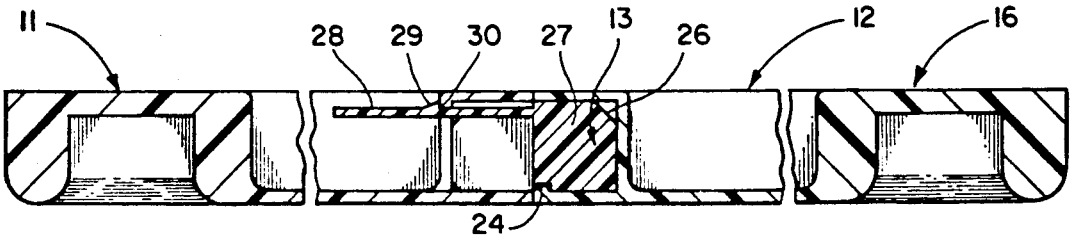
FIG. 6 is an enlarged vertical section taken on line 6—6 looking in the direction indicated by the arrows as seen in FIG. 2 illustrating one form of an insert part.
Figure 7:
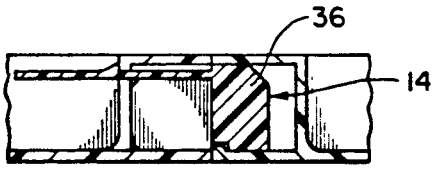
FIG. 7 is an enlarged vertical section showing the insert part in assembled relation with the rigid parts, and illustrating a modified type of an insert part.
Figure 8:
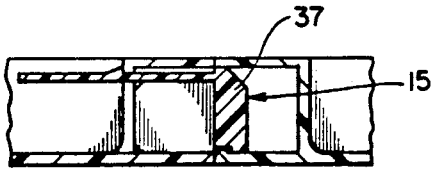
FIG. 8 is an enlarged vertical section showing still another modified type of an insert part.

The insert part 13 can vary in width and this difference is shown in FIGS. 6, 7 and 8, where in FIG. 7 one modified insert part 14 is shown and in FIG. 8 where still another modified part 15 is shown.

It is important to note that regardless of which insert piece or part that is used with the rigid parts, the overall length of the board remains the same. As will be further observed from a review of the drawings, and particularly FIGS. 6, 7 and 8, it will there be seen that the size or length of the elements 27 (FIG. 6) 36 (FIG. 7) and 37 (FIG. 8) varies, and yet the length of the board does not vary. The result can occur because the channel opening in which the parts 27, 36 and 37 are engaged is of sufficient size to receive any one of the insert heads 27, 36 and 37 without varying the length of the board.

Most desirably, the 5" width is common to all my insert parts and the lengths vary as stated. The parts are all identical to one another except for the difference in the bottom due to the chamfer.

Figure 9:
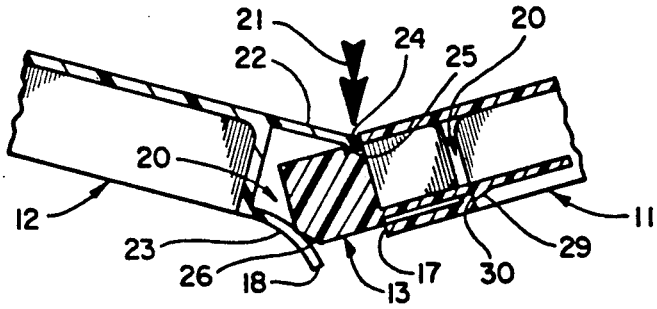
FIG. 9 is a fragmentary enlarged vertical section similar to FIG. 6 only showing an arrow indicated how a karate block causes the parts to become uncoupled or disengaged.

Preferably, it is my intention to sell a karate striking board kit 10, which will include additional insert parts so that the user can use anyone of the insert parts as may be desired to form a karate striking board 16 as illustrated in FIGS. 1-3. The insert parts 13, 14 and 15 are all of a reusable nonbreakable type according to important features of my invention thus eliminating waste. When the karate striking board 16 is fragmented causing its parts to separate by the application of a blow to it, as indicated by the arrow 21 in FIG. 9, the insert part 13 is caused to separate away from the second rigid part 12 as shown in FIG. 9 and as will now be further described.

It will be seen that the first rigid part 11 and the second rigid part 12 have confronting edges 17 and 18 which are also provided with spaced apart confronting cavities 19 and 20.

The insert part 12 is provided with an upper flange or lip 22 and a lower flange or lip 23. The lips or flanges 22 and 23 must be carefully configurated depending on the material used so that these components can work in a proper manner with the insert part 13 to enable the rigid part 12 and the insert part 13 to come apart when a blow is applied in the direction indicated at 21, as shown in FIG. 9.

Figure 5:
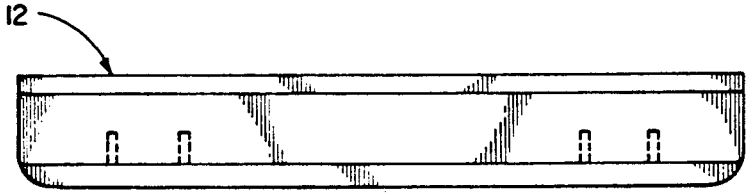
FIG. 5 is an enlarged end view of the right half of the striking board as viewed on the line 5—5 looking in the direction indicated by the arrows as seen in FIG. 1.
Figure 10:
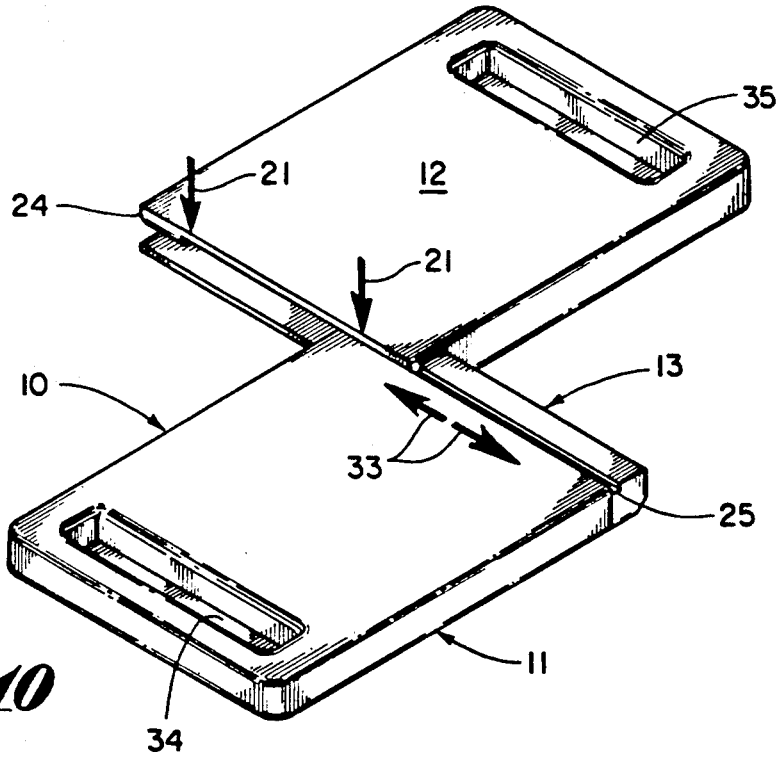
FIG. 10 is an enlarged perspective view of the karate board shown in FIG. 1 illustrating how one of the rigid parts is assembled with the insert part.

The rigid part 12 has an end that is provided with a pair of upper and lower flexible lips or flanges 22 and 23, and these flanges must be carefully constructed in order for my karate striking board 16 to function properly. The rigid parts 11 and 12 are in reality semi-rigid in the sense that a flexible joint exists between the insert part and one of the so-called rigid parts. The parts 11 and 12 are in fact stiff and it is only the flexible joint that is flexible upon receiving a karate blow. The flexing action actually occurs in the flanges or lips of the rigid part, and to this extent the rigid part is flexible but only at the joint. In the manufacture of my board 16, I have experimented with a number of different types of materials, and after encountering three materials that were unsatisfactory due to breakage, I found a material known as 82G33L "Zytel" which is manufactured by DuPont, and this material proved to be satisfactory for the board 16 where the upper flange was manufactured having a thickness of 0.166", and the bottom flange was manufactured having a thickness of 0.135". The material known as 82G33L "Zytel" is an impact modified co-polymer based on 6-66 nylon and the actual material is 33% glass filled. The upper flange 23 has beads as indicated at 24-24 (FIG. 1 and 10). These beads are very important so that the rigid parts 11 and 12 can be separated in the appropriate direction from one another when a blow is struck as indicated at 21 in FIG. 9 to the bead area 24 causing the insert part 13 to become disengaged from the rigid part 12. More specifically, the insert part 13 has a groove 25 provided as indicated in FIG. 9 and the beads 24-24 are engageable therein. Located on a diagonally opposite corner of the insert part 13 is a chamfered edge 26. The chamfered edge 26 has a 45° chamfer for allowing the insert part 13 to be more readily disengaged from the groove 25 and the surfaces defining the groove including the lip 23 when an impact force is struck against the multi part board 16, as shown in FIG. 9. The chamfer 26 is at a 45° angle relative to an upright plane through an upright outer edge of the main section 36 (FIG. 7). The surface 26 can be shaped as a chamfer or otherwise suitably configured to enable the engaged surfaces to separate as shown in FIG. 8 so that the main section 36 with the chamfer 26 can be released by the lip 23 as the lip fluxes (FIG. 9) enabling the main section (36) to escape the cavity 20. Both the groove 25 and the chamfer edge 26 are located on main insert section 27 of the insert part 13. Also connected and formed integral with the insert part 13 is a deflectable tongue or flange 28 as seen in FIGS. 5 and 9. The tongue 28 has a deflectable locking shoulder 29 which is adapted to co-act with a rigid locking shoulder 30 carried on the rigid part 11. When the insert part 13 is to be assembled with the rigid part 11, the deflectable tongue is aligned with the cavity 19 and pushed into the cavity until the deflectable locking shoulder 29 snaps behind the rigid locking shoulder 30 on the rigid part 11 which will be found to be noticeable when a "click" is heard. At this instant, the insert part 13 is securely connected to the rigid part 11, and the snap action between the deflectable locking shoulder 29 and the rigid locking shoulder 30 insures that these components are in the solid connection together. Tongue latch only operated when insert piece is to be changed. To separate the rigid part 11 from the insert part 13, the tongue 28 is depressed to cause the deflectable tongue or flange 28 to become free and disengaged from the rigid locking shoulder 30 whereupon the insert part 13 and its deflectable tongue or flange 28 can be withdrawn from the cavity 19 provided in the rigid part 11. This prevents any pieces from injuring participants.

It will further be observed that according to other features of my invention, the insert part 13 has been provided with transversely spaced apart lugs part 31,31 which are located on opposite sides 28 as seen in FIGS. 1 and 2 amongst others. Still further, the cavity 19 has a pair of vertically positioned stabilizer flanges 32,32 which are transversely spaced between one another to provide a sub-cavity 19*a* in which the deflectable tongue or flange 28 is adapted to be received. These stablizer flanges 32,32 are adapted to co-act with side edges of the deflectable tongue or flange to aid in the centering and proper positioning of the tongue in the cavity 19 when the insert part 13 is being assembled with the rigid part 11. It will further be seen that the lugs 31,31 are located outside of the sub-cavity 19*a*, and to the outer sides of the flanges 32,32 when the parts 11 and 13 are in assembly together.

When the karate striking board 16 is to be used, a person can hold the board by engaging fingers into board grooves 34 and 35 which are provided on the same side of the board as the locking bead 24. Thus, when the force such as indicated by the arrow 21 is applied to the board 16, the fingers of the person holding the board will be located on the same side of the board as the side where the force 21 is being applied.

In order to provide boards of varying strength, I have found that the configuration and bulk of the main section can be varied. To this end, main section 36 of insert 14 and main section 37 of insert part 15 have been configured in varied ways as shown in FIGS. 6 and 7. Thus, my karate striking board kit can include a series of different sized insert parts as indicated at 13, 14 and 15 all of which have varied sized main sections as indicated at 27, 36 and 37 respectively. The amount of force required to be applied at the arrow 21 can vary depending on the length of the main section 27 or 36 or 37. The length of the section is made longer where it is desired that greater force be needed to separate the parts and conversely the main section is made shorter where it is desired to decrease the amount of force needed to flex the lower lip or flange 23 to cause the parts to be separated. Another imperative feature to insure that a uniform breaking force will cause a uniform result in separating the parts of the board 16 concerns the configuration of the bead 24 and the groove 25. The matching groove and bead enable the force to be transferred to the flexible legs action as a fulcrom.

The chamfered edge at 26 on the insert part is provided to enable the deflectable lip or flange 23 to be separated without shearing the flexible lip or flange 23 along the rigid part 12. In summary, the depth of the cavity in rigid part 11, the length of the main section as indicated at 27 on board 16 and the fact of engagement of the beads 24 are always the same. The beads 24 and the groove 25 are all critical to insuring that the board 16 will operate in a consistent manner when subjected to a breaking force such as indicated by the arrow 21 in FIG. 9.

When the striking force is applied to the board 16 as indicated in 21, it will be seen that the flange 23 is caused to flex over the chamfered edge 26 of the insert part 13 thereby permitting the rigid part 12 to be separated from the other parts 11 and 13. When the parts are separated or disengaged, they can be readily reassembled since the flange 23 has a memory and is configurated and constructed so as to return to its original position after the board parts have been separated as previously described. This type of construction allows the board to be struck repeated blows causing the parts to be separated and then reassembled so that the user can use the board in repeated practice exercises.

While only one embodiment of the invention has been disclosed, it is understood that one skilled in the art may realize other embodiments of the invention, therefore one should study the drawings, description and claims for a complete understanding of the invention.

I claim:

1. A reusable karate striking board kit comprising first and second substantially rigid parts having spaced apart confronting edges and spaced apart confronting cavities in said confronting edges, the confronting cavity in one of said confronting edge of said first and second rigid parts extending widthwise providing side cavity openings, the another confronting cavity in another of said confronting edge of said first and second rigid parts being closed at transversely opposite ends, a plurality of reusable, non-breakable insert parts alternatively and selectably constructed for assembly and reassembly between said first and second rigid parts, said insert parts each having opposite insert margins for coaction with said confronting edges and said confronting cavities, said insert margins each having portions thereof removably insertable in said confronting cavities of said first and second rigid parts to render said confronting edges of said first and second rigid parts contiguous with said opposite insert margins of an associated one of said insert parts, one of said insert margins being temporarily joined with a contiguous one of said first and second rigid parts and temporarily joined along an elongated transverse junction positioned there between, each of said insert parts having varied lengths to require varied karate strike forces at said junction to separate said insert part from only one of said first and second rigid parts, and releasable joint means between one of said insert parts and an associated one of said first and second rigid parts, said releasable joint means releases upon being struck by a karate strike force against the associated one of said insert part, one of said portions of said insert margins having an integral longitudinally extending locking tongue, the locking tongue having an offset locking projection, said locking tongue being retainingly engageable in said another confronting cavity of said first and second rigid parts, said another confronting cavity of said first and second rigid parts having a locking cavity shoulder and with said offset locking projection engaged behind said locking cavity shoulder to secure said insert part in assembly, the locking tongue being manually depressible to release and disengage said offset locking projection from said locking cavity shoulder to disengage said insert part, said insert part has a pair of transversely spaced stabilizing lugs positioned on opposite sides of said locking tongue, said stabilizing lugs and said locking tongue being simultaneously engaged in said another confronting cavity of said first and second rigid parts for securement.

2. The kit of claim 1 further including sliding lock means, said sliding lock means is located between said confronting cavity in said confronting edge of said one of said first and second rigid parts extending widthwise providing side cavity openings and a selected one of said insert parts enabling said one of said first and second rigid parts to be assembled and disassembled by relative transverse sliding movement with respect to said insert part utilizing sliding lock means to effect assembly thereof.

3. The kit of claim 1, wherein the another portion of said insert margins has a chamfered inner edge for disposition in said confronting cavity in said confronting edge of said one of said first and second rigid parts extending widthwise providing side cavity openings, said confronting cavity in said confronting edge of said one of said first and second rigid parts extending widthwise providing side cavity openings having a deflectable lip, and said releasable joint means include said deflectable lip deflectable over said chamfered inner edge upon karate strike force being struck against the associated one of said insert parts permitting said insert parts and one of said first and second parts to become disengaged from the insert part previously assembled therewith.

4. The kit of claim 3, wherein said first and second rigid parts and said insert parts being comprised of a glass filled impact modified copolymer synthetic plastic, said deflectable lip being 0.166" thick, and with said chamfered inner edge being at a 45° angle relative to an upright plane through said chamfered inner edge.

5. The kit of claim 3, wherein said first and second rigid parts and said insert parts being comprised of a glass filled impact modified copolymer synthetic plastic, said deflectable lip being 0.166" thick, and with the chamfered inner edge being at a 45° angle relative to an upright plane through said chamfered inner edge, said glass filled impact modified copolymer synthetic plastic being 33% glass filled.

6. The kit of claim 1 further including sliding lock means, said sliding lock means is located between said confronting cavity in said confronting edge of said one of said first and second rigid parts extending widthwise providing side cavity openings and said insert part, the another portion of said insert margins has a chamfered inner edge for disposition in said confronting cavity in said confronting edge of said one of said first and second rigid parts extending widthwise providing side cavity openings with said chamfered inner edge comprising a component of said sliding lock means, said confronting cavity in said confronting edge of said one of said first and second rigid parts extending widthwise providing side cavity openings having a deflectable lip deflectable over said chamfered inner edge upon said karate strike force being struck against the associated one of said insert parts permitting said insert parts and one of said first and second rigid parts to become disengaged from the insert part previously assembled therewith, said deflectable lip also comprising another component of said sliding lock means.

7. The kit of claim 1, wherein the another portion of said insert margins has a chamfered inner edge for disposition in said confronting cavity in said confronting edge of said one of said first and second rigid parts extending widthwise providing side cavity openings, said first and second parts and said insert parts being comprised of a synthetic plastic, said releasable joint means having a flexible flange, said flexible flange being deflectable over said chamfered inner edge on said insert part, said flexible flange having a memory characteristic so that the flexible flange can return to an original position after being deflected over said chamfered inner edge for reuse in a repetitive manner.

8. A reusable karate striking board comprising first and second substantially rigid parts, said first and second rigid parts having spaced apart confronting edges and spaced apart confronting cavities in said confronting edges, a reusable, non-breakable insert part constructed for assembly and reassembly when located between said first and second rigid parts, said insert part having opposite insert margins for coaction with said confronting edges and said confronting cavities, said insert margins having portions thereof removably insertable in said confronting cavities of said first and second rigid parts to render said confronting edges of said first and second rigid parts contiguous with said opposite insert margins of said insert part, one of said insert margins being temporarily joined with a contiguous one of said first and second rigid parts and temporarily joined along an elongated transverse junction positioned there between, said insert part being separate at said junction when subjected to a karate strike force to separate said insert part from only one of said first and second rigid parts, and releasable joint means between said insert part and an associated one of said first and second rigid parts, said releasable joint means releases upon being struck by said karate strike force against said insert part, one of said portions of said insert margins having an integral longitudinally extending locking tongue, the locking tongue having an offset locking projection, said locking tongue being retainingly engageable in said another confronting cavity of said first and second rigid parts, said another confronting cavity of said first and second rigid parts having a locking cavity shoulder and with said offset locking projection engaged behind said locking cavity shoulder to secure said insert part in assembly, the locking tongue being manually depressible to release and disengage said offset locking projection from said locking cavity shoulder to disengage said insert part, said insert part has a pair of transversely spaced stabilizing lugs positioned on opposite sides of said locking tongue, said stabilizing lugs and said locking tongue being simultaneously engaged in said another confronting cavity of said first and second rigid parts for securement.

9. The reusable karate striking board of claim 8 further including sliding lock means, said sliding lock means is located between said confronting cavity in said confronting edge of said one of said first and second rigid parts extending widthwise providing side cavity openings and said insert parts enabling said one of said first and second rigid parts to be assembled and disassembled by relative transverse sliding movement with respect to said insert part utilizing sliding lock means to effect assembly thereof.

10. The reusable karate striking board of claim 8, wherein said confronting cavity in said confronting edge of said one of said first and second rigid parts extending widthwise providing side cavity openings having a deflectable lip, said releasable joint means includes a chamfered inner edge on the another portion of said insert margins for disposition in said confronting cavity in said confronting edge of said one of said first and second rigid parts extending widthwise providing side cavity openings and said deflectable lip retainingly engaged with said another portion of said insert margins in adjacency to said chamfered inner edge, said deflectable lip being deflectable over said chamfered inner edge upon said karate strike force being struck against said insert part permitting said insert part and one of said first and second rigid parts to become disengaged from the insert part previously assembled therewith.

11. The reusable karate striking board of claim 10, wherein said first and second rigid parts and said insert part being comprised of a glass filled impact modified copolymer synthetic plastic, said deflectable lip being 0.166" thick, and with said chamfered inner edge being at a angle relative to an upright plane through said chamfered inner edge, said glass filled impact modified copolymer synthetic plastic being 33% glass filled.

12. The reusable karate striking board of claim 10, wherein said first and second parts and said insert part being comprised of a synthetic plastic, said deflectable lip having a memory characteristic so that said deflectable lip can return to an original position after being deflected over said chamfered inner edge for reuse in a repetitive manner.

13. The reusable karate striking board of claim 8 further including sliding lock means, said sliding lock means is located between said confronting cavity in said confronting edge of said one of said first and second rigid parts extending widthwise providing side cavity openings and said insert part, the another portion of said insert margins has a chamfered inner edge for disposition in said confronting cavity in said confronting edge of said one of said first and second rigid parts extending widthwise providing side cavity openings with said chamfered inner edge comprising a component of said sliding lock means, said confronting cavity in said confronting edge of said one of said first and second rigid parts extending widthwise providing side cavity openings having a deflectable lip deflectable over said chamfered inner edge upon said karate strike force being struck against said insert part permitting said insert part and one of said first and second rigid parts to become disengaged from the insert part previously assembled therewith, said deflectable lip comprising another component of said sliding lock means.

* * * * *